US006523509B2

(12) United States Patent
Kramer et al.

(10) Patent No.: US 6,523,509 B2
(45) Date of Patent: Feb. 25, 2003

(54) TWO-STROKE ENGINE

(75) Inventors: Jochen Kramer, Waiblingen (DE); Lars Bergmann, Welzheim (DE); Michael Raffenberg, Fellbach (DE); Heiko Rosskamp, Adelberg (DE)

(73) Assignee: Andreas Stihl AG & Co., Waiblingen (DE)

( * ) Notice: Subject to any disclaimer, the term of this patent is extended or adjusted under 35 U.S.C. 154(b) by 0 days.

(21) Appl. No.: 09/945,623

(22) Filed: Sep. 5, 2001

(65) Prior Publication Data

US 2002/0026912 A1 Mar. 7, 2002

(30) Foreign Application Priority Data

Sep. 6, 2000 (DE) ..... 100 44 023

(51) Int. Cl.[7] ..... F02B 33/04
(52) U.S. Cl. ..... 123/73 PP; 123/635
(58) Field of Search ..... 123/73 A, 73 PP, 123/73 B, 65 P, 635

(56) References Cited

U.S. PATENT DOCUMENTS 4,483,279 A 11/1984 Köhler et al. ..... 123/41.65
6,142,113 A * 11/2000 Mochizuka et al. ..... 123/65 P
6,152,093 A * 11/2000 Sawada et al. ..... 123/73 PP

FOREIGN PATENT DOCUMENTS

WO WO 98/57053 12/1998 ..... F02B/25/16

* cited by examiner

*Primary Examiner*—Noah P. Kamen
(74) *Attorney, Agent, or Firm*—Walter Ottesen

(57) ABSTRACT

The invention relates to a two-stroke engine for a portable handheld work apparatus such as a motor-driven chain saw, cutoff machine, brushcutter or the like. A crankcase (4) is formed below the engine cylinder (2). A piston (5) moves up and down in the cylinder (2) and drives a crankshaft (7) rotatably journalled in the crankcase (4). A fuel-containing mixture is supplied via a membrane carburetor (8) to the combustion chamber (3) delimited between the piston (5) and the cylinder (2). A bypass channel (22) is provided parallel thereto and supplies essentially fuel-free air to the combustion chamber (3). The bypass channel (22) opens into a channel segment (21) via a connecting piece (24) fixedly attached to the cylinder (2). The channel segment (21) is formed in the cylinder wall (16). A spark plug (20) and an ignition control device (34) are assigned to the combustion chamber (3). The ignition control device (34) is fixedly mounted with a portion to the cylinder (2) via one attachment point (40) and is fixedly mounted to the connecting piece (24) via another attachment point (41).

15 Claims, 4 Drawing Sheets

TWO-STROKE ENGINE

FIELD OF THE INVENTION

The invention relates to an internal combustion engine for a portable handheld work apparatus such as a motor-driven chain saw, cutoff machine, brushcutter or the like.

BACKGROUND OF THE INVENTION

An internal combustion engine of this kind is disclosed in international patent publication WO 98/57053 and is provided especially for use in portable handheld work apparatus such as motor-driven chainsaws, cutoff machines, brushcutters, blowers, overhead branch cutters or like work apparatus. The usual configuration comprises essentially a cylinder and a crankcase arranged below the cylinder. The piston moves reciprocally in the cylinder and drives a crankshaft rotatably journalled in the crankcase. For operating the engine, an air/fuel mixture is supplied to the crankcase via a carburetor. With a downward stroke of the piston, the mixture flows into the combustion chamber via transfer channels formed in the cylinder wall. In order to minimize scavenging losses, the transfer channels are connected to a bypass channel approximately at the elevation of the transfer windows and this bypass channel conducts exclusively fuel-free air. The bypass channel opens into a channel segment of the transfer channel next to the transfer window via a membrane valve.

A spark plug is necessary for operating the engine and is mostly mounted in the roof of the combustion chamber and is driven by an ignition control device. An ignition control device of this kind is disclosed, for example, in U.S. Pat. No. 4,483,279 and comprises a stationary ignition transformer which is fixed on the cylinder of the engine and operates together with an ignition magnet which rotates with the crankshaft. The ignition magnet is advantageously integrated into the fan wheel for moving cooling air to the engine and is flange-connected to the end of the crankshaft. For this reason, the ignition transformer must be fixed in a predetermined position on the cylinder.

In two-stroke engines having charge stratification or scavenging advance, the bypass channel for the supply of the fuel-free air lies approximately at half elevation of the cylinder whereby the attachment possibilities for an ignition transformer of the ignition control device are limited.

SUMMARY OF THE INVENTION

It is an object of the invention to provide an internal combustion engine of the above-mentioned type which is so improved that a reliable and permanently fixed arrangement of the ignition module is ensured. It is a further object of the invention to provide this permanently fixed arrangement of the ignition module with only slight additional constructive complexity.

The internal combustion engine of the invention is for a portable handheld work apparatus including a motor-driven chain saw, cutoff machine, brushcutter or the like. The internal combustion engine includes: a cylinder having a cylinder wall; a piston mounted in the cylinder to undergo a reciprocating movement along a stroke path between top dead center and bottom dead center during operation of the engine; the cylinder and the piston conjointly delimiting a combustion chamber; a crankcase connected to the cylinder; a crankshaft rotatably mounted in the crankcase; a connecting rod connecting the piston to the crankshaft to permit the piston to drive the crankshaft as the piston reciprocates in the cylinder; a mixture forming device for supplying a fuel containing mixture to the combustion chamber; a channel segment formed in the cylinder wall and communicating with the combustion chamber via a controlled window; a connecting piece fixedly attached to the cylinder; a bypass channel communicating with the channel segment via the connecting piece to supply essentially fuel free air to the combustion chamber; a spark plug arranged in the combustion chamber; an ignition device mounted in the region of the cylinder; and, the ignition device having a part thereof fixedly attached with at least one attachment point to the connecting piece.

With the arrangement of at least the one attachment point of the ignition module on the connecting piece of the bypass channel, the region of the transfer channel can also be utilized as an attachment region. The attachment point of the ignition module lies close to the crankcase. If a first attachment point is provided on the connecting cover and a second attachment point is provided on the cylinder, then a large spacing between the attachment points can be achieved constructively whereby the ignition module can be fixedly mounted on the cylinder. Attachment points which lie at a large spacing with respect to each other in the direction of the cylinder axis provide a high stability which is resistant also to the intense vibrations of the two-stroke engine over a long service life.

An imaginary connecting line between the attachment points can lie approximately parallel to the cylinder axis. An arrangement of the crankcase end attachment point offset in the peripheral direction to the cylinder-head end attachment point can be advantageous.

In a special embodiment of the invention, it can be sufficient to provide all attachment points of the ignition module on the connecting piece so that the ignition module can be mounted as an assembly unit with the connecting piece. This mounting can also take place in advance of fixing the cover on the cylinder.

In a further embodiment of the invention, each attachment point is defined by a screw dome which can be configured as one piece with the cylinder and/or as one piece with the connecting piece. The bypass channel lies between the attachment point viewed in the direction of the cylinder axis so that a large spacing can be formed between the attachment points in the direction of the cylinder axis.

Preferably, the attachment piece is configured as a cover which closes the channel segment open to the outside of the cylinder. Preferably, the connecting piece is fixed with threaded fasteners to the cylinder. The attachment point of the ignition module on the cover can lie close to the screw point of the cover.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
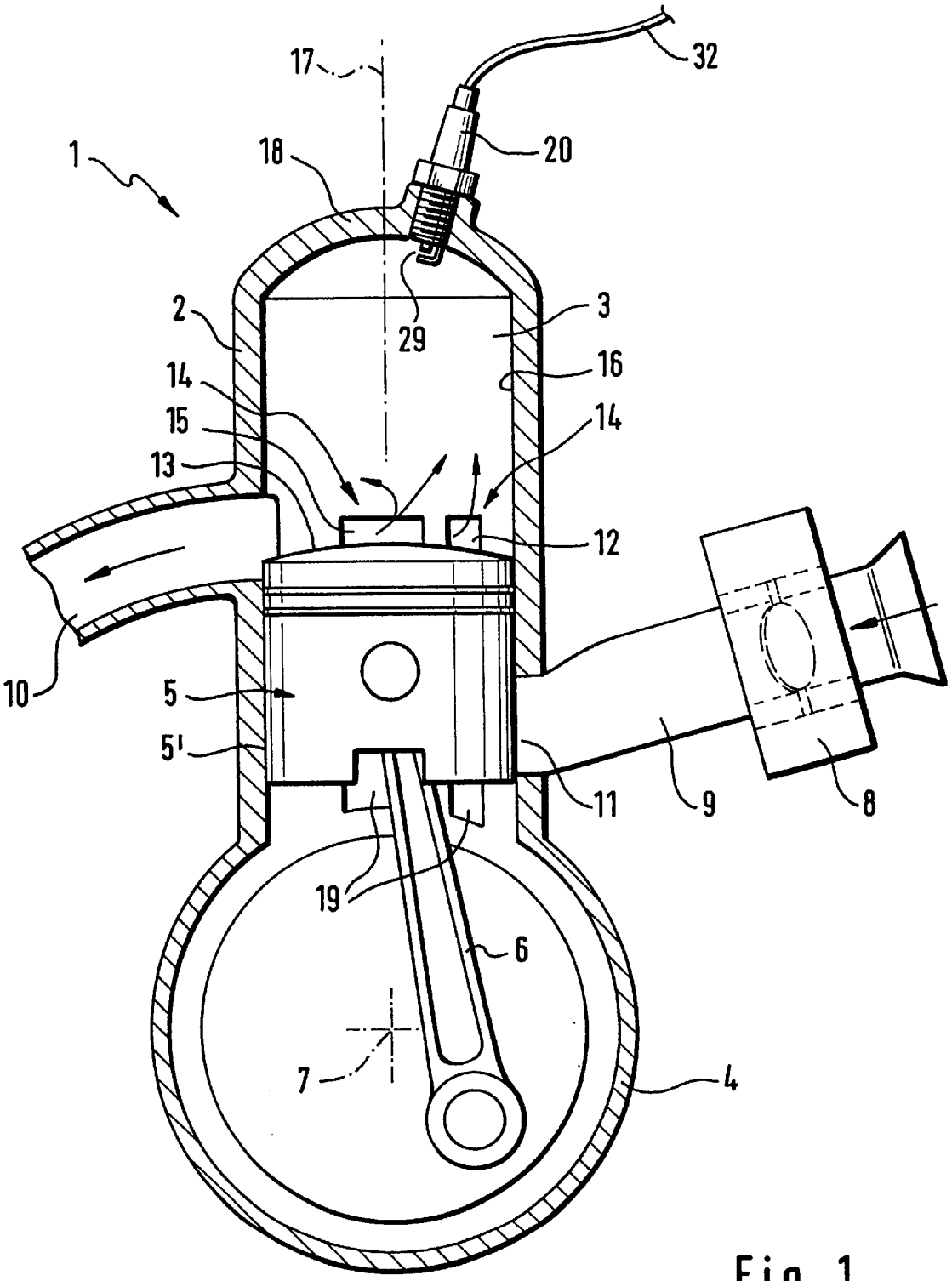
FIG. 1 is a schematic section view taken through a two-stroke engine having advance air scavenging.

The two-stroke engine 1 shown schematically in FIG. 1 comprises essentially a cylinder 2 as well as a piston 5 which moves up and down within the cylinder 2. With a connecting rod 6, the piston 5 rotatably drives a crankshaft 7 journalled in a crankcase 4.

A combustion chamber 3 is formed in cylinder 2 and is delimited by the base 13 of the piston 5. The combustion chamber 3 includes an outlet 10 via which combustion gases are discharged after a work stroke. The mixture, which is necessary for operating the two-stroke engine, is an air/oil/fuel mixture and is supplied to the crankcase 4 from a mixture preparation device 8 via an inlet 11 and an inlet channel 9. The mixture preparation device is advantageously a membrane carburetor of conventional configuration.

Figure 2:
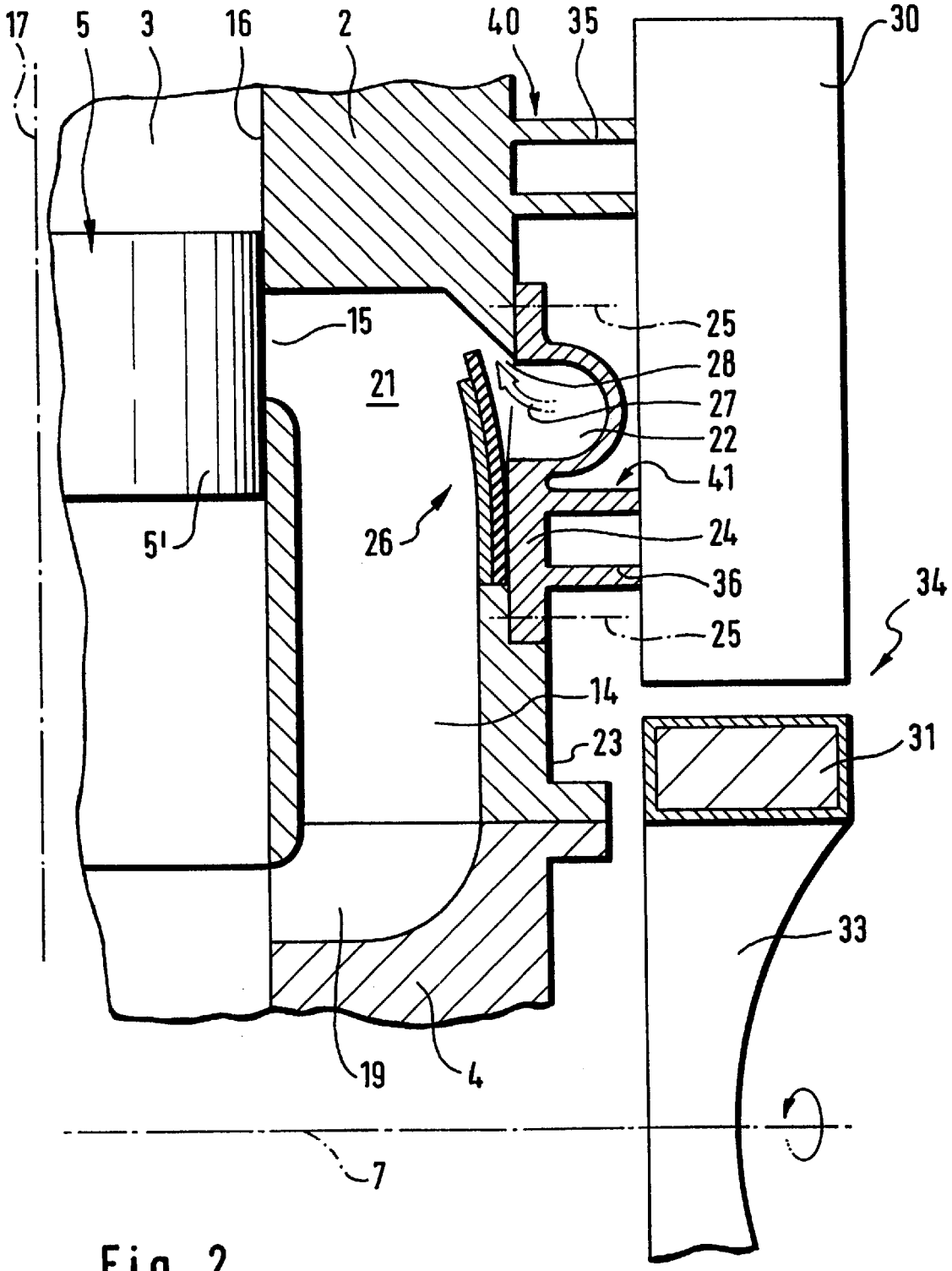
FIG. 2 is an enlarged view of a section taken through a scavenging channel close to the outlet with the ignition module fixedly attached to the cylinder.

In the embodiment shown, the inlet 11 is slot controlled by the skirt 5' of the piston. The inlet 11 is completely closed by the piston skirt 5' for the stroke position of the piston 5 shown in FIG. 1. The piston 5 is disposed shortly ahead of its bottom dead center point and, for this reason, the mixture, which is drawn by suction into the crankcase 4, was compressed during the travel of the piston toward bottom dead center and, after the transfer windows 12 and 15 are opened, the mixture flows into the combustion chamber 3. In the embodiment, each transfer channel 14 runs in the cylinder wall 16 essentially parallel to the cylinder axis 17 as shown in FIG. 2. The transfer channels 14 can, however, have a position and configuration which departs from the embodiment shown.

As shown in FIG. 1, two transfer channels 14 are arranged on each side of the outlet 10 so that a two-stroke engine configured in this manner can be operated with appropriate control of an air supply to the transfer channels 14 as a scavenging advance air engine as well as a stratified charge engine.

The upper end of the transfer channel 14 faces toward the cylinder head 18 and opens into the combustion chamber 3 via transfer windows 12 and 15, respectively, in the cylinder wall 16; whereas, the second end 19 of each transfer channel faces toward the crankcase 4 and opens thereto.

As shown in FIG. 2, the outlet-near transfer channel 14 with the transfer window 15 is open to the cylinder outside 23 in the region of the channel segment 21 following the transfer window 15 in order to connect to a bypass channel 22 via a connecting piece 24. As shown in FIG. 2, the connecting piece 24 is configured as a cover and is fixed at attachment points 25 to the cylinder 2. The attachment points are indicated schematically in FIG. 2 and are configured as threaded fastener points 25. The number of necessary threaded fastener points is determined in accordance with the size and configuration of the connecting piece 24 configured as a cover.

As shown in FIG. 2, the bypass channel 22 opens via a membrane valve 26 into the channel segment 21, so that, for an induction stroke of the piston 5, the underpressure, which develops in the crankcase 4 and therefore also in the transfer channel 14, opens the membrane valve 26 so that fuel-free air can flow through the opening gap 28 in the direction of arrow 27. The fuel-free air flows in the direction of the crankcase 4 and fills the transfer channel 14 completely with air.

In a next downward stroke of the piston 5, the mixture is again compressed in the crankcase 4 and flows via the open ends 19 into the transfer channels 14. In this way, the air, which is advanced in the outlet-near transfer channel 14, enters into the combustion chamber via the outlet-near transfer window 15 and scavenges the residual gases; whereas, the mixture enters into the combustion chamber 3 essentially via the outlet-remote transfer channel 14 and its window 12.

In the next upward stroke, the mixture introduced into the combustion chamber 3 is compressed and ignited via the spark plug 20. For this purpose, a corresponding ignition pulse is supplied to the spark plug 20 which takes place via the ignition transformer 30 shown in FIG. 2. An ignition magnet 31 is assigned to the ignition transformer 30 and rotates with the crankshaft 7. The ignition magnet 31 triggers a voltage pulse when running past the ignition transformer 30. This ignition pulse is supplied to the spark plug 20 via an ignition cable 32 and leads to an electrical ignition spark at the electrodes 29 of the spark plug. The ignition magnet 31 can advantageously be integrated, for example, in the fan wheel 33 of a cooling air arrangement.

The rotating ignition magnet 31 and the ignition transformer 30 conjointly define an ignition control unit 34.

Referred to the crankshaft 7, the transfer channels 14 lie on the axial end faces of the crankshaft 7 and, for this reason, the ignition magnet 31 is mounted, for example, via the fan wheel 33, on the end of the crankshaft 7 and rotates therewith. Correspondingly, the ignition module, that is, the ignition transformer 30, must be fixed on the side of the two-stroke engine 1 on which the connecting pieces 24 for the bypass channels 22 also lie. In order to ensure a reliable fixed mounting of the ignition module 30, this part of the ignition control device 34 is fixed with a first attachment point 41 on the connecting piece 24 and with a second attachment point 40 on the engine cylinder 2.

Departing from the embodiment shown, several attachment points can be provided on the connecting cover 34. Accordingly, the ignition module 30 can also be fixed with all attachment points only on the connecting cover.

As shown in FIG. 2, in the embodiment, the fixed part of the ignition control device 34 is the ignition transformer 30 which is mounted via screw domes (35, 36) on the cylinder 2. The one screw dome 35 is formed integral with the cylinder 2 and the other screw dome 36 is formed integral with the connecting piece 24. FIG. 2 further shows that the bypass channel 22 lies between the attachment points 40 and 41, that is, the threaded fastener domes 35 and 36, respectively, viewed in the direction of the cylinder axis 17. In this way, a large distance can be provided between the threaded fastener domes 35 and 36 viewed in the direction of the cylinder axis 17 which provides a high mechanical stability.

Figure 3:
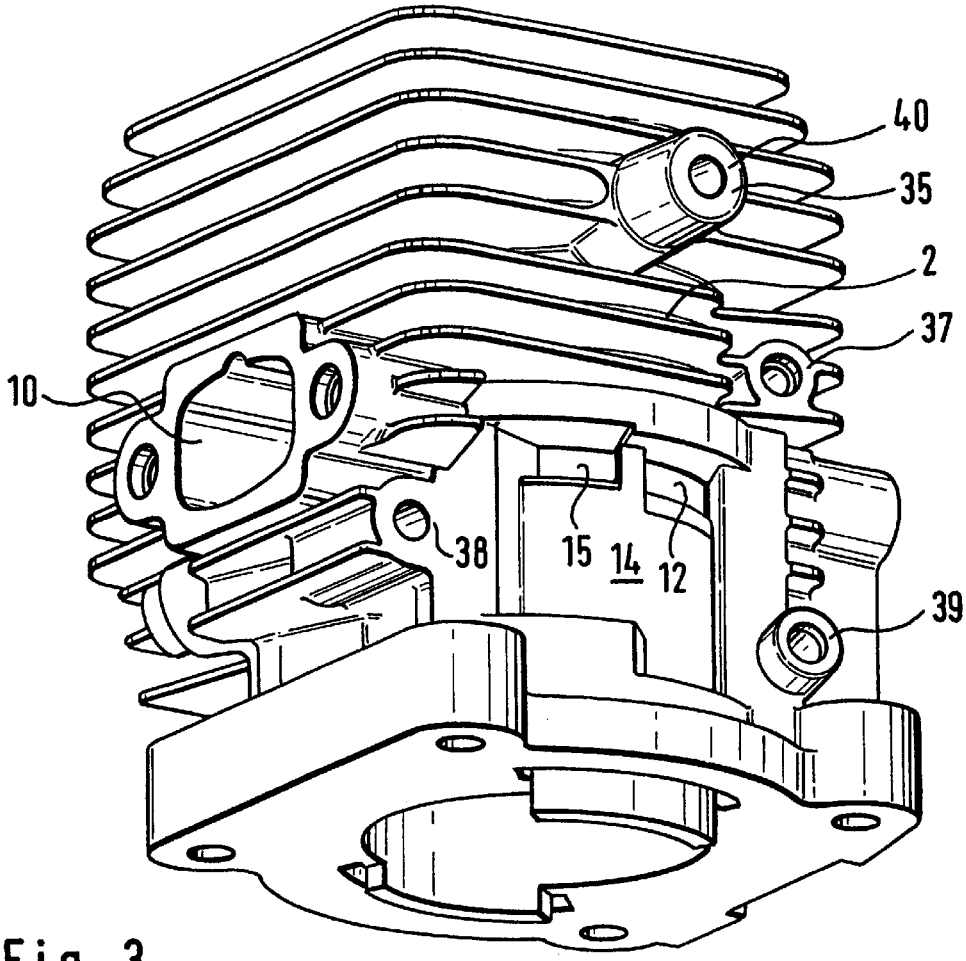
FIG. 3 is a schematic showing a perspective view of a cylinder head having a transfer channel open to the outside of the cylinder.
Figure 4:
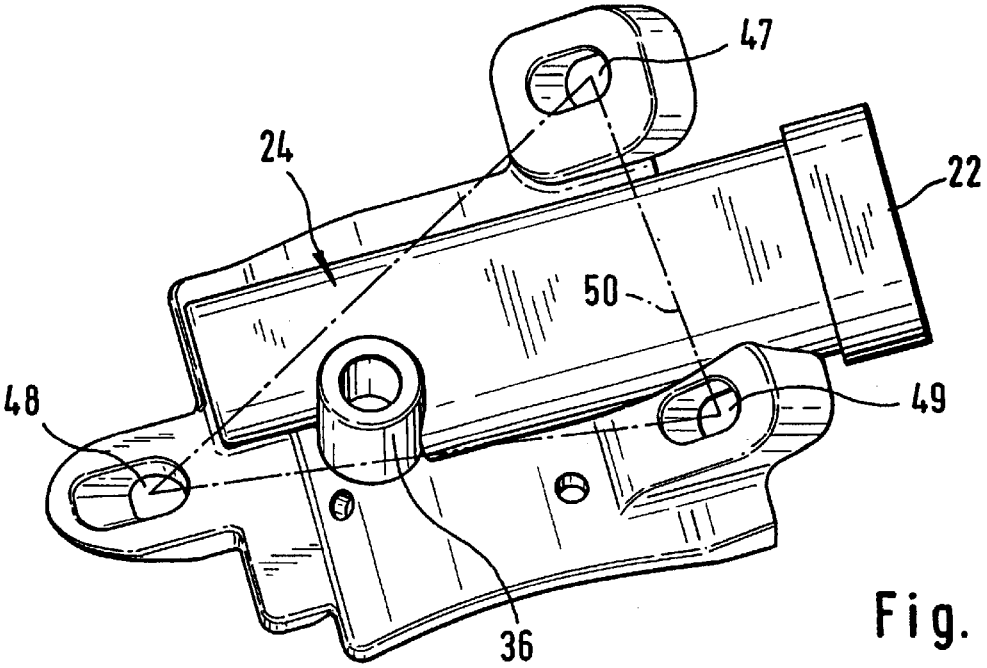
FIG. 4 is a perspective view of a connecting piece which is configured as a cover and closes the transfer channel shown in FIG. 3; and, FIG. 5 is a respective schematic view of an ignition module mounted on the cylinder head.
Figure 5:
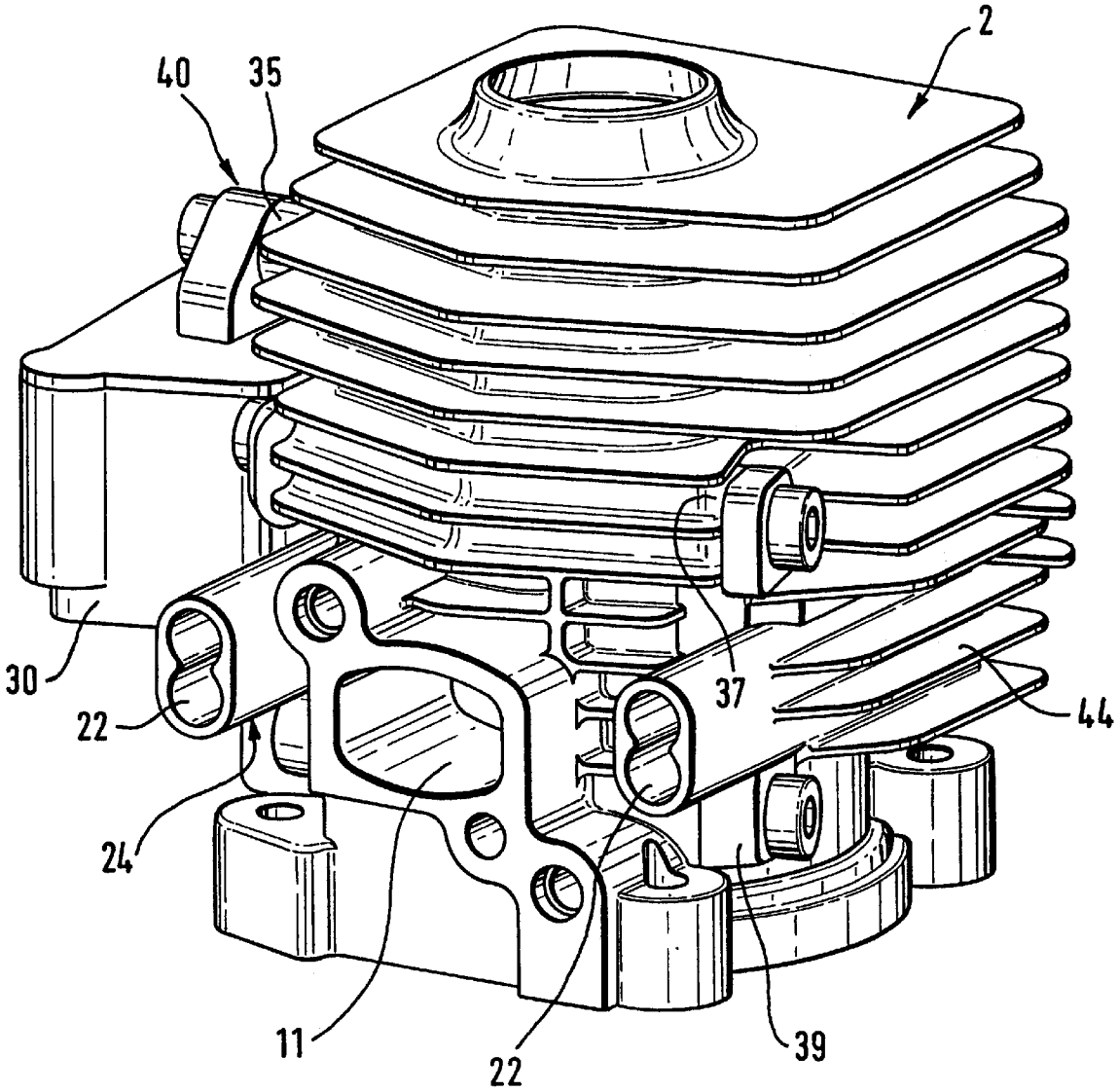

An embodiment of a cylinder 2 is shown in FIGS. 3 to 5 wherein the transfer channel 14 is open over approximately its entire length to the outer side of the cylinder. The connecting piece 24 is configured as a cover and is seated on this transfer channel 14 open to the outside and is fixed. Here, the connecting piece 24, which forms the cover, is preferably screwed tightly to the cylinder 2. For this purpose, connecting domes 37 to 39 are formed on the cylinder 2. Threaded fastener openings (47, 48, 49) are assigned to these connecting domes in suitable attachment flanges of the connecting piece 24. The positions of the fastener domes 37 to 39 (that is, the threaded fastener openings 47 to 49) are so selected that the screw openings 47 to 49 define the corners of an approximately isosceles triangle 50. The threaded fastener dome 36 is provided for the attachment of the ignition module 30 and lies next to a fastener point, especially in the region of the angle of the two legs of the triangle 50 which are approximately equal.

In FIG. 5, a further variation of the cylinder 2 for an internal combustion engine 1 according to the invention is shown. The connecting piece 24 has supplementary cooling ribs 44 on its side facing away from the cylinder 2 to improve a transfer of heat away from the cylinder 2. In FIG. 5, the ignition module 30 is mounted on the side facing away from the viewer and is fixed with the aid of threaded fastener domes as shown in FIGS. 3 and 4.

The subject matter of the invention is advantageously applicable to small engines and especially in portable handheld work apparatus. The engines have a size of 20 to 150 $cm^3$, especially 30 to 60 $cm^3$.

It is understood that the foregoing description is that of the preferred embodiments of the invention and that various changes and modifications may be made thereto without departing from the spirit and scope of the invention as defined in the appended claims.

What is claimed is:

1. An internal combustion engine for a portable handheld work apparatus including a motor-driven chain saw, cutoff machine, brushcutter or the like, the internal combustion engine comprising:

a cylinder having a cylinder wall;

a piston mounted in said cylinder to undergo a reciprocating movement along a stroke path between top dead center and bottom dead center during operation of said engine;

said cylinder and said piston conjointly delimiting a combustion chamber;

a crankcase connected to said cylinder;

a crankshaft rotatably mounted in said crankcase;

a connecting rod connecting said piston to said crankshaft to permit said piston to drive said crankshaft as said piston reciprocates in said cylinder;

a mixture forming device for supplying a fuel containing mixture to said combustion chamber;

a channel segment formed in said cylinder wall and communicating with said combustion chamber via a controlled window;

a connecting piece fixedly attached to said cylinder;

a bypass channel communicating with said channel segment via said connecting piece to supply essentially fuel free air to said combustion chamber;

a spark plug arranged in said combustion chamber;

an ignition device mounted in the region of said cylinder; and, said ignition device having a part thereof fixedly attached with at least one attachment point to said connecting piece.

2. The internal combustion engine of claim 1, wherein said channel segment is formed in said cylinder wall so as to be open to the outer side of said cylinder wall; and, said connecting piece is configured as a cover closing said channel segment to said outer side of said cylinder wall; and, said cover being fixedly attached to said cylinder.

3. The internal combustion engine of claim 2, wherein said cover is fixedly attached to said cylinder with threaded fasteners.

4. The internal combustion engine of claim 3, wherein said threaded fasteners hold said cover to said cylinder at respective connecting points; and, said first attachment point is disposed close to one of said connecting points.

5. The internal combustion engine of claim 4, wherein said connecting piece has a first end facing toward said bypass channel and a second end lying opposite said first end; said connecting piece having two of said connecting points being disposed at said first end of said connecting piece; and, said connecting piece having at least one connecting point at said second end of said connecting piece.

6. The internal combustion engine of claim 5, wherein said two connecting points at said first end of said connecting piece and said one connecting point at said second end of said connecting piece conjointly define approximately an equilateral triangle.

7. The internal combustion engine of claim 1, wherein said part of said ignition device is the ignition transformer.

8. The internal combustion engine of claim 1, wherein said internal combustion engine further comprises a transfer channel formed in said cylinder wall to connect said crankcase to said combustion chamber and said channel segment being part of said transfer channel.

9. The internal combustion engine of claim 8, wherein said cylinder defines a longitudinal axis; and, said transfer channel being formed in said cylinder wall so as to be open to the outer side of said cylinder wall over approximately the entire length of said transfer channel measured in the direction of said longitudinal axis.

10. An internal combustion engine for a portable handheld work apparatus including a motor-driven chain saw, cutoff machine, brushcutter or the like, the internal combustion engine comprising:

a cylinder having a cylinder wall;

a piston mounted in said cylinder to undergo a reciprocating movement along a stroke path between top dead center and bottom dead center during operation of said engine;

said cylinder and said piston conjointly delimiting a combustion chamber;

a crankcase connected to said cylinder;

a crankshaft rotatably mounted in said crankcase;

a connecting rod connecting said piston to said crankshaft to permit said piston to drive said crankshaft as said piston reciprocates in said cylinder;

a mixture forming device for supplying a fuel containing mixture to said combustion chamber;

a channel segment formed in said cylinder wall and communicating with said combustion chamber via a controlled window;

a connecting piece fixedly attached to said cylinder;

a bypass channel communicating with said channel segment via said connecting piece to supply essentially fuel free air to said combustion chamber;

a spark plug arranged in said combustion chamber;

an ignition device mounted in the region of said cylinder;

said ignition device having a part thereof fixedly attached with at least one attachment point to said connecting piece;

said channel segment being formed in said cylinder wall so as to be open to the outer side of said cylinder wall;

said connecting piece being configured as a cover closing said channel segment to said outer side of said cylinder wall;

said cover being fixedly attached to said cylinder;

said cover having a side facing away from said cylinder; and, said cover having cooling ribs formed on said side thereof.

11. The internal combustion engine of claim 10, wherein said cylinder has cooling ribs formed thereon and said cooling ribs of said cover are parallel to said cooling ribs of said cylinder.

12. An internal combustion engine for a portable handheld work apparatus including a motor-driven chain saw, cutoff machine, brushcutter or the like, the internal combustion engine comprising:

a cylinder having a cylinder wall;

a piston mounted in said cylinder to undergo a reciprocating movement along a stroke path between top dead center and bottom dead center during operation of said engine;

said cylinder and said piston conjointly delimiting a combustion chamber;

a crankcase connected to said cylinder;

a crankshaft rotatably mounted in said crankcase;

a connecting rod connecting said piston to said crankshaft to permit said piston to drive said crankshaft as said piston reciprocates in said cylinder;

a mixture forming device for supplying a fuel containing mixture to said combustion chamber;

a channel segment formed in said cylinder wall and communicating with said combustion chamber via a controlled window;

a connecting piece fixedly attached to said cylinder;

a bypass channel communicating with said channel segment via said connecting piece to supply essentially fuel free air to said combustion chamber;

a spark plug arranged in said combustion chamber;

an ignition device mounted in the region of said cylinder;

said ignition device having a part thereof fixedly attached with at least one attachment point to said connecting piece;

said attachment point being a first attachment point; and, said ignition device being fixedly attached to said cylinder at a second attachment point.

13. The internal combustion engine of claim 12, wherein said first and second attachment points are defined by first and second screw domes formed on said connecting piece and said cylinder, respectively.

14. The internal combustion engine of claim 13, wherein said first dome is formed as one integral piece with said connecting piece and said second dome is formed as one integral piece with said cylinder.

15. The internal combustion engine of claim 13, wherein said cylinder defines a cylinder axis and said bypass channel lies between said first and second attachment points viewed in the direction of said cylinder axis.

* * * * *